United States Patent [19]

Perucchi

[11] Patent Number: 4,459,031

[45] Date of Patent: Jul. 10, 1984

[54] ELECTRONIC TIMEPIECE

[75] Inventor: Norberto Perucchi, St. Blaise, Switzerland

[73] Assignee: ETA A.G. Ebauches-Fabrik, Canton of Soleure, Switzerland

[21] Appl. No.: 255,747

[22] Filed: Apr. 20, 1981

Related U.S. Application Data

[63] Continuation-in-part of Ser. No. 196,357, Oct. 14, 1980, abandoned.

[51] Int. Cl.[3] ..... G04C 17/00; G04B 23/02

[52] U.S. Cl. ..... 368/69; 368/74; 368/80

[58] Field of Search ..... 368/69, 72–74, 368/76, 80, 155–157, 185, 187, 223, 228, 250–251

[56] References Cited

U.S. PATENT DOCUMENTS 4,205,519 6/1980 Deruns ..... 368/73
4,223,523 9/1980 Kamijo ..... 368/74
4,259,737 3/1981 Berney ..... 368/66
4,266,288 5/1981 Berney ..... 368/69 X
4,358,840 11/1982 Ono et al. ..... 368/251

*Primary Examiner*—Vit W. Miska
*Attorney, Agent, or Firm*—Parkhurst & Oliff

[57] ABSTRACT

A motor normally drives a gear-train which controls the hands when the motor is acted upon by pulses it receives from a driving circuit and which come from a divider and a quartz oscillator. In order to set an alarm to the desired time, a stem is moved by means of a crown to a setting position. The gear-train is then driven by a pinion and a wheel meshing with one another. The alarm time is recorded by a counter circuit owing to pulses supplied by a contact of a rotary detector. This time is stored in a memory when a push button is pressed. After the hands are returned to a position indicating the correct time of day, the counter circuit counts the elapsed time, and the alarm is set off when a coincidence circuit detects coincidence between the count of the counter and the data stored in the memory.

6 Claims, 8 Drawing Figures

ELECTRONIC TIMEPIECE

This is a continuation-in-part of co-pending application Ser. No. 196,357, filed Oct. 14, 1980, now abandoned.

This invention relates to electronic timepieces, and more particularly to an electronic timepiece, especially a wrist watch, of the type having a stepping motor and an analog display.

The availability of integrated MOS circuits and other more recent technologies, especially microprocessor technology, has opened up very wide possibilities as concerns the addition of auxiliary functions to circuits suitable for use in wrist watches. However, the possibilities thus offered are not capable cf practical application unless appropriate input means are found, as well as interesting uses, making it possible to take advantage of the opportunities offered by such circuits under optimum conditions. Thus, the provision of coincidence circuits for ascertaining whether the rotor of the stepping motor has actually rotated one step when a pulse is supplied by the driving circuit allows the operation of the motor to be corrected automatically by making up for steps lost as a result of a shock or of the effect of an exterior magnetic field upon the watch. In order to provide such a function, however, the watch must include appropriate detector means. Detector gearing has already been proposed for this purpose, e.g., in the form of a disk having a peripheral hole which passes in front of an LED and allows a flash emitted by the diode to strike a photocell if there is synchronism between the rotation of the motor and the transmission of the output pulse from the frequency divider.

It is an object of this invention to provide an electronic timepiece, especially a wrist watch, which has an alarm device performing several functions, and which is both attractive and practical in its design, utilizing the simplest possible input means to actuate logic circuits incorporated in the timepiece.

To this end, the electronic timepiece according to the present invention comprises means for displaying time data; means for producing a time base signal; means for producing a first and a second manual command; means for producing a control signal; means responsive to the time base signal and to the control signal for driving the displaying means; means responsive to the time base signal and to the control signal for producing a displaying means position signal; means responsive to the first manual command and to the position signal for storing an alarm time signal; means responsive to the position signal and to the alarm time signal for producing a comparison signal; means responsive to the comparison signal for producing an alarm signal; and means responsive to the manual commands, to the control signal and to the time base signal for producing a difference signal; wherein the control signal producing means is responsive to the comparison signal, to the difference signal and to the manual commands for producing the control signal.

An electronic timepiece of this kind can be produced with a simplified display device comprising only one set of hands, so that the alarm time is set by moving the hands which usually indicate the time of day to the desired position on the dial. As will be explained below, a timepiece of this kind can be regulated and controlled simply by two control elements, viz., a stem, similar to the winding and setting stems of conventional mechanical watches, and a push button.

Preferred embodiments of the invention will now be described in detail with reference to the accompanying drawings, in which.

Figure 1:
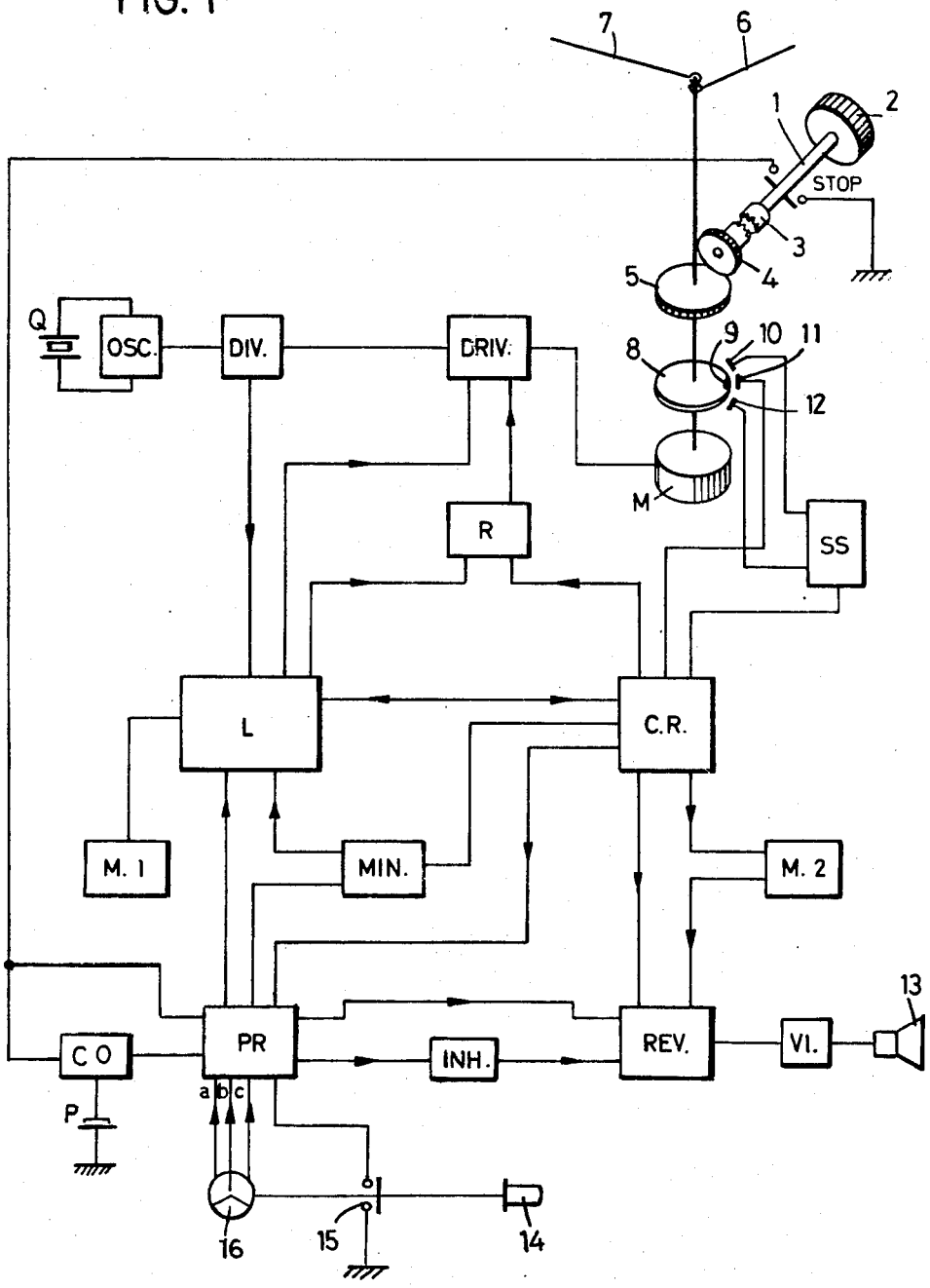
FIG. 1 is a block diagram of the circuitry in a first embodiment.

The circuitry diagrammed in FIG. 1 is that of an alarm wrist watch comprising, in addition to the alarm device settable by means of the ordinary hands, a system for making up for accidental jumps of the motor, a timezone correction system, and, of course, a setting device for adjusting the indication of the time to the second.

As outer control means, the watch includes a control stem 1, similar to a winding and setting stem of a conventional mechanical watch, provided with a crown 2 and capable of controlling a clutch-pinion 3, e.g., by means of a setting-lever and a yoke (not shown). Clutchpinion 3 meshes with a setting-wheel 4 when stem 1 is pulled out from its normal position. It will be noted that the setting position, in which clutch-pinion 3 engages setting-wheel 4, may be a third position, the intermediate position being a day and/or date correction position, for example. In the setting position, a contact STOP, which acts upon the circuitry, as will be seen below, is closed.

Figure 4:
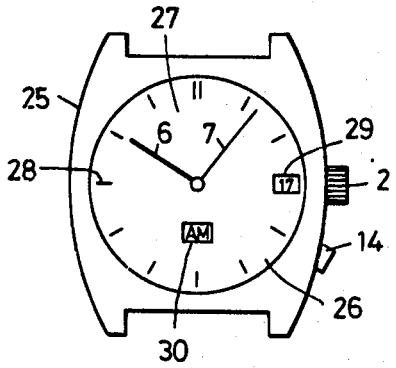
FIGS. 4 to 6 are top plan views of various designs of the display system.
Figure 5:
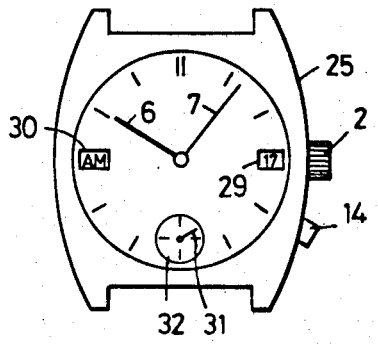
Figure 6:
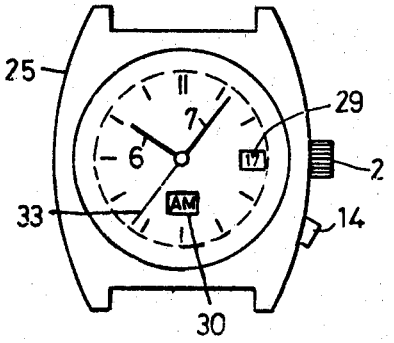

Setting-wheel 4 meshes with a setting-wheel 5 intended in the drawing to symbolize the gear-train as a whole, which is driven by a stepping motor M with suitable reduction, the rotation of wheel 5 being transmitted to two coaxial hands 6 and 7 indicating the hours and the minutes, respectively, on a dial 27 (see FIGS. 4–6).

In a watch of this kind, motor M will, for example, effect one step every 20 seconds, thereby advancing hand 7 three steps per minute. There will preferably be no seconds hand. In other embodiments, however, a seconds hand 31 or 33 (FIGS. 5 and 6) and a stepping motor advancing one step per second may be provided. The transmission will then be such that each step of the motor corresponds to an advance of 6° of the seconds hand.

In normal operation, motor M is actuated by means of a battery P which energizes all the circuitry. A quartz crystal Q cooperating with an oscillator circuit OSC constitutes the time-standard. The high-frequency pulses transmitted by circuit OSC are divided in a divider DIV; the resultant low-frequency pulses are then shaped in a circuit DRIV and thus feed motor M. The latter is a reversible motor, so that if the polarity of the pulses from circuit DRIV is inverted, the direction of rotation of motor M is reversed.

The performance of the various functions of the watch is made possible by the inclusion of a rotary detector 8 in the gear-train. Depending upon the particular embodiment, detector 8 will be keyed either on an arbor rotating with the seconds hand, i.e., making one revolution per minute, or on an arbor rotating more slowly, as the case may be. In the embodiment now being described, rotary detector 8 includes at its periphery a contact element 9 which, during each rotation, successively comes in contact with three fixed elements 10, 11, and 12 disposed next to one another adjacent to the periphery of detector 8. Elements 10 and 12 are connected to a circuit SS which determines the direction of rotation of detector 8, while contact element 11 is connected to a circuit C.R. which is an auxiliary counter capable of counting the number of revolutions made by detector 8. This rotation detector may be designed in various ways. For example, detector 8 may include several contacts. Detection by optical means might be provided instead.

The circuitry of the watch further includes as an important element a logic circuit L capable of carrying out various operations depending upon how it is programmed by means of a program control circuit PR. Depending upon the function to be performed, circuits C.R., L, and PR also coöperate with a step-compensation circuit R, a seconds-reset circuit MIN, an elapsed-time storage circuit M.1, and an alarm-time storage circuit M.2. For the alarm function, a coincidence circuit REV, an energizing circuit VI for powering a buzzer 13, an inhibitor circuit INH, and an initializing circuit designated C.O. are also provided. The sound-emitter 13 may be any sort of vibrator.

The program control circuit PR responds either to pulses coming from other circuits of the watch or to pulses coming from outside. The latter pulses are introduced into circuit PR by a secondary control device which includes a push button 14 mounted on the watch case as will be described below with reference to FIGS. 4–6. Push button 14 is arranged in such a way that when it is pressed, a contact 15 is caused to close, and a pulse is consequently supplied to circuit PR. When stem 1 is in the setting position, on the other hand, pressing push button 14 causes a 120° rotation of a rotary part 16 shown diagrammatically in FIG. 1. Part 16 will be arranged to rotate in only one direction and will include a disk visible through an aperture in the dial. As will be explained below in connection with FIGS. 4–6, part 16 can cause one of the indications AM, PM, or NO to appear in the aperture. Depending upon the position of part 16, potentials of 0 or 1 are applied to three inputs a, b, and c of circuit PR as a function of a three-position code, corresponding to three states of program circuit PR and, consequently, to three possibilities of sending commands to the circuits connected to circuit PR.

The functions of the watch shown in FIG. 1 will now be described, starting with those specifically related to the setting and triggering of the alarm.

When stem 1 is pulled into the setting position, contact STOP is closed, so that circuit PR sends to logic circuit L the command to stop pulses from being transmitted to motor M, which therefore ceases running. Furthermore, pinion 3 is coupled to setting-wheel 4, so that rotation of stem 1 entails rotation of the gear-train. As soon as motor M stops running, the pulses from divider circuit DIV are diverted to memory M.1, where they are counted. Therefore, if hands 6 and 7 are turned manually by means of crown 2, the direction of rotation is detected by circuit SS, and the number of revolutions of detector 8 is counted positively or negatively by circuit C.R. depending upon the direction detected by circuit SS. When hands 6 and 7 have been set to the desired alarm time, the wearer of the watch must press push button 14. The closing of contact 15 causes the count of counter C.R. to be transferred to memory M.2. At the same time, disk 16 rotates one step. The operation of push button 14 should be repeated so that the indication (AM, PM, or NO) appearing in the dial aperture (see FIGS. 4, 5, or 6) corresponds to the 12-hour period during which the alarm is supposed to go off. If the indication NO is displayed, the alarm will not be set off at all, whereas if AM or PM is displayed, and if the circuits are correctly initialized as will be explained below, the alarm will sound during the period before or after noon, as desired. Once the alarm has thus been programmed, crown 2 is pushed into its normal position, whereby contact STOP is opened. For a certain time, the pulses leaving divider DIV continue to be supplied to memory M.1. On the other hand, the opening of contact STOP controls logic circuit L so that it sends circuit DRIV a certain number of rapid pulses, e.g., at a frequency of 32 c/s, controlling via motor M the automatic return of hands 6 and 7 to their proper positions. The number of pulses to be thus supplied to circuit DRIV is calculated on the basis of the count of counter C.R. as introduced into memory M.2 and on the basis of the data stored in memory M.1, corresponding to the time elapsed during the operation. Once hands 6 and 7 have been returned to the correct time thus calculated, the pulses from divider DIV are duly redirected to circuit DRIV to power motor M at the normal speed. It will be noted that if motor M normally steps once every 20 seconds, a correction of 6 hours, which corresponds to the maximum possible displacement of the hands, will take a total of about 35 seconds at the rate of 32 steps per second.

As soon as the gear-train is once more in a position corresponding to the correct time of day, the revolutions of detector 8 are counted by counter C.R. starting from 0, and the momentary count of this counter is continuously transmitted to coincidence circuit REV, where it is compared with the data stored in memory M.2. When the count of counter C.R. coincides with the data stored in memory M.2, two possibilities may exist. If indicator part 16 is in the NO position or in a position (AM or PM) which does not correspond to the total sum of the counted time stored by counter C.R., the coincidence signal is inhibited by the action of circuit INH. If, on the other hand, the count of counter C.R. is equal to a number of pulses transmitted by contact 11 signifying that the present time of day corresponds to the a.m. or p.m. period displayed in the dial aperture by part 16, then the coincidence signal transmitted by circuit REV is supplied to the vibrator energizing circuit VI, and alarm component 13 emits a characteristic sound.

This sound will be cut off by operation of push button 14 provided that stem 1 is in its normal position. If, on the other hand, push button 14 is not pressed, the alarm signal ceases after a certain predetermined time. In either case, the alarm circuit remains programmed, so that the alarm will go off again 24 hours later.

Finally, as concerns the programming of the alarm functions, circuit PR is further arranged to perform the following functions: if push button 14 is pressed during normal running of the watch and when buzzer 13 is not sounding, circuit PR sends logic circuit L a command to transmit rapid pulses to driving circuit DRIV. While the pulses from divider DIV are stored, motor M drives hands 6 and 7 rapidly until there is coincidence between the count of counter C.R. and the data stored in memory M.2, so that the hands indicate the time for which the alarm is set. After a certain lapse of time, say, one minute, or after push button 14 is pressed again, logic circuit L once more supplies rapid pulses to cause motor M to run in the opposite direction and return the hands automatically to the correct time, taking the elapsed time into account. The pressing of push button 14 when stem 1 is in its normal position does not change the position of disk 16.

Before other embodiments of the invention are described, the functions of the auxiliary devices included in the watch of FIG. 1 will be explained. These auxiliary devices are not indispensable for performing the alarm functions and might be eliminated in modified versions. This is obvious from the fact that it has been possible to describe all the alarm functions above without reference to these auxiliary circuits or functions.

A stem position other than that for setting the alarm might be provided for setting the hands. However, in the watch being described, setting of the hands is carried out with the stem in the same position as for setting the alarm as explained above. In addition, this position also allows for a change of the time zone. Thus, contact STOP is closed, and setting-wheel 4 is coupled to clutch-pinion 3. Rotation detector 8 coöperates with circuit C.O. and operates as follows:

When battery P is put in place, the first step to be taken consists precisely in pulling stem 1 into the setting position. The closing of contact STOP then conditions circuit C.O. to act upon circuit PR. The rotation imparted to hands 6 and 7 for the first time via stem 1 is then stored in circuit C.R., and care must be taken to initialize this counter correctly by setting the hands to the correct time a.m. or p.m. The moment stem 1 is pushed back into its normal position, after the hands have been set to the exact time—possibly simultaneously with a standard time signal—motor M duly starts running at its normal speed.

If stem 1 is subsequently pulled out again into the setting position, circuit C.O. registers a second pulse and transmits to circuit PR the indication that this is not the first time the hands have been set. The axial displacement of the stem may correspond to any one of three different situations:

1 - It may be an error, the wearer of the watch having wished to put the stem in the date-correction position but having pulled too hard. In this case, the stem will be pushed back in place without having effected any rotation. Counter C.R. has not counted any pulse. Logic circuit L, via circuit DRIV, sends motor M rapid pulses corresponding to the period of time stored in memory M.1, i.e., the time during which the motor was stopped, so that the hands are once more positioned to indicate the correct time.

2 - It is a correction of the time of day, so that this correction necessarily involves only a slight displacement of the hands. For practical purposes, the limit may be considered a displacement corresponding, for example, to half a time-zone correction, i.e., 7½ min., 15 min., or 30 min., as the case may be. If counter C.R. records fewer rotations than the limit thus defined, it acts upon logic circuit L; and when the stem is restored to its normal position, motor M starts up at its usual rate without receiving any rapid pulses. The pulses stored in memory M.1 are erased.

3 - An angular displacement exceeding the limit defined under 2 above has been imparted to the hands by manipulation of the stem. Counter C.R., having recorded this displacement, causes logic circuit L to carry out the following operations: it compares the number of pulses counted by counter C.R. with the closest number corresponding to the time-span of a time zone. It calculates the number of pulses which must be supplied to motor M in order to set the hands rapidly to a time which differs from that previously indicated by a whole number of time zones and deducts from this number the time elapsed during the operation as continuously stored in memory M.1. When the stem is then pushed back into its normal position, without push button 14 having been pressed, logic circuit L supplies via circuit DRIV the rapid pulses which will set the hands to the correct time corresponding exactly to that of the time zone which had been set approximately by hand.

The functions which have been described thus far have left any intervention by circuit MIN entirely out of consideration. Without this circuit, the hands stop in the position they occupy at the exact moment when the stem is pulled into the setting position. However, this instant rarely corresponds to a full minute. When the indicator members consist only of an hour hand and a minute hand, as is the case in the first embodiment described, this situation might just be acceptable; but this is not so if the watch is also equipped with a seconds hand, which may be the case as will be seen below. Moreover, even if no seconds hand is provided, the seconds are nevertheless counted. In these various cases, it may be advantageous always to have the counting system in a state corresponding to a full minute when motor M stops running. This is the function performed by circuit MIN. From the instant when the stem is pulled into the setting position, circuit MIN causes logic circuit L to supply rapid pulses causing motor M to advance until the hands are in a position corresponding to a full minute. At the same time, the number of such pulses is stored in memory M.1 so that it can be deducted upon the return to normal running.

Lastly, the circuitry of the watch described further includes means in the form of step-compensation circuit R for making up automatically for accidental jumps of motor M. Circuit R is a coincidence circuit connected both to logic circuit L and to counter C.R. If, as a result of a shock or of the presence of a magnetic field, motor M has stepped excessively or has not reacted to a normal pulse supplied by circuit DRIV, the state of coincidence measured by circuit R and normally verified continuously is broken. The breaking of this coincidence causes circuit R to transmit pulses to circuit DRIV. Motor M is then either blocked for several periods or accelerated until coincidence is restored.

In the first embodiment described above, the hands are moved mechanically by means of the stem when the latter is in the setting position, and they are driven at a rapid rate by electronic means when their positions are to be altered once the stem has been returned to its normal position. However, other designs of the control system are equally possible without departing from the spirit of the invention.

Thus, for one thing, the transmission of rapid pulses by logic circuit L to driving circuit DRIV might be completely eliminated. In this case, any motion imparted to the hands would have to take place by means of crown 2. Therefore, after the alarm time has been set by pressing push button 14, it would be necessary to return the hands to the correct time manually just before pushing the stem back into its normal position. Automatic setting of the correct time would then no longer be possible, and the wearer of the watch would have to reset the hands precisely whenever an alarm time has been set.

Figure 2:
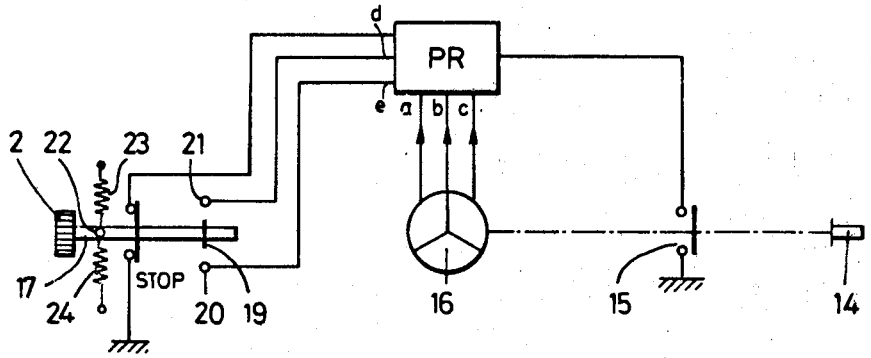
FIG. 2 is a partial block diagram of a second embodiment

The contrary situation is illustrated in FIG. 2, a diagram of an embodiment in which the hands can be moved by completely electronic means in all circumstances. FIG. 2 shows only those parts of the circuitry which are modified as compared with FIG. 1. Reappearing in FIG. 2 are crown 2, contact STOP, circuit PR, part 16 controlled by push button 14, contact 15, and the three inputs a, b, and c by which the position of part 16 can be transmitted to circuit PR.

The wrist watch in this second embodiment comprises a control stem 17 provided with crown 2. This stem can likewise be moved axially and rotatingly, but it controls neither a setting-wheel nor a pinion. It bears contact STOP, as in the first embodiment, so that this contact is closed when stem 17 is pulled out into the setting position. Stem 17 additionally bears a contact element 19 which projects laterally from stem 17 and describes an arcuate path when stem 17 rotates. Since this stem is grounded by the closing of contact STOP, it suffices to to turn crown 2 in one direction or the other in order for contact element 19 to ground one or the other of two fixed studs 20 and 21 situated on either side of stem 17. These studs may be fixed to the plate of the movement and will be suitably insulated therefrom. Studs 20 and 21 are connected to inputs d and e of circuit PR. Depending upon the direction in which stem 17 is rotated, a potential of 0 is applied to one or the other of these inputs, and this situation conditions circuit L so that via circuit DRIV, the motor receives rapid pulses of the proper polarization to cause forward or backward movement of the hands.

Stem 17 will also be provided with a lateral pin 22 cooperating, for example, with two springs 23 and 24 so that stem 17 will constantly be returned to a particular position in which element 19 is separated from contacts 20 and 21. The system of parts 22, 23, 24 might be replaced by a cam and a spring blade instead. As long as crown 2 is kept turned in one direction or the other, the hands move rapidly in one direction or the other. As a control system of this kind may very well be combined with a reset circuit such as circuit MIN, the hands are also returned to a position corresponding to a full minute as soon as the stem ceases to be actuated.

Figure 3:
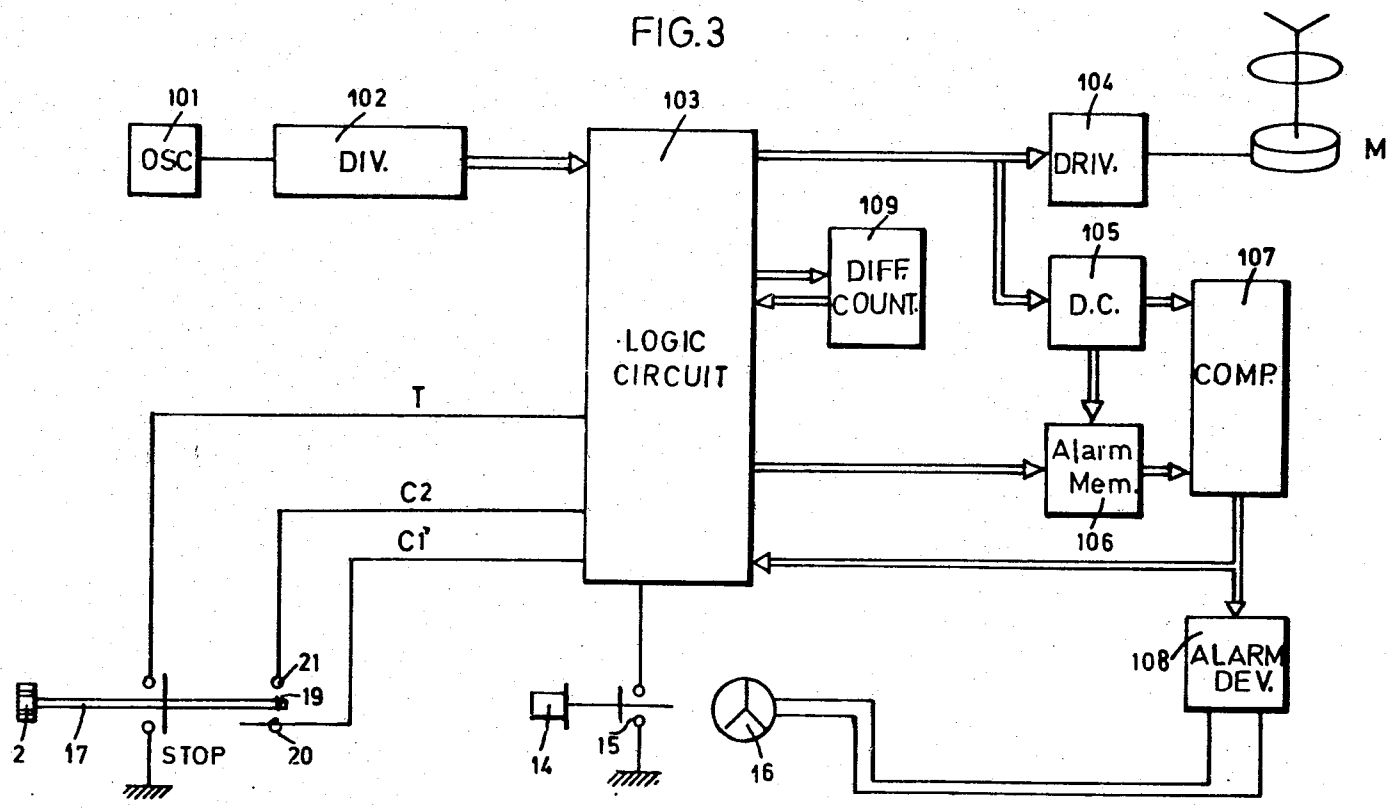
FIG. 3 is a block diagram of another embodiment.

FIG. 3 shows a further embodiment in which the gear-train does not include any rotary detector. Reappearing in this embodiment are the control device of FIG. 2 with crown 2 keyed on stem 17, contact STOP, and contact 19 capable of grounding either terminal 20 or terminal 21. Push button 14 controlling contact 15 and actuating rotary disk 16 is likewise shown.

The time-standard in the embodiment of FIG. 3 will be seen to comprise a quartz oscillator 101 and a frequency divider 102 which supplies pulses at a frequency of 1/60 c/s to a logic circuit 103 to be described below.

In normal operation, logic circuit 103 transmits these pulses to a driving circuit 104, which in turn supplies driving pulses to motor M, and to a display counter 105. As will also be seen below, the count of counter 105 always corresponds to the number of hours and minutes indicated by the position of the hands driven by motor M.

When the count of counter 105 becomes equal to the information stored in an alarm-time memory 106, a comparator 107 supplies a comparison signal to an alarm device 108 which then sounds the alarm, always provided that disk 16, described in relation to FIG. 2, is in the proper position.

When contact STOP is closed by pulling out stem 17, logic circuit 103 cuts off the transmission of pulses from the time-standard to driving circuit 104 and to counter 105 and redirects these pulses to a two-way difference counter 109 composed of a minute counter and an hour counter which can be reset independently of one another. Counter 109 counts the pulses down, i.e., in reverse, so that its count corresponds to the lag between the time indicated by the hands and the correct time.

If contact STOP is re-opened without the closing of contacts 15, 20, and 21, also described in connection with FIG. 2, logic circuit 103 sends correction pulses, at a frequency of 32 c/s, for example to driving unit 104, to display counter 105 and to difference counter 109. These correction pulses will obviously be supplied in such a way that difference counter 109 counts them up, i.e., forward, and that motor M runs in its normal direction. When difference counter 109 reaches zero once more, logic circuit 103 cuts off the supply of correction pulses and resumes transmission of the time-standard pulses to driving circuit 104 and to display counter 105.

If contact 20 or 21 is also closed by rotation of stem 17 when contact STOP is closed, logic circuit 103 once more sends correction pulses to driving circuit 104, to display counter 105, and to difference counter 109. The direction in which motor M runs and in which counters 105 and 106 count is determined by which one of the contacts, 20 or 21, is closed. Difference counter 109 records the divergence, in one direction or the other, between the time indicated by the hands and the correct time.

If, after this operation, contact 15 is closed by pressure on push button 14, logic circuit 103 sends a control signal to alarm-time memory 106, which then assumes a state corresponding to that of display counter 105. Hence memory 106 stores the time then indicated by the hands as the new alarm time.

When stem 17 is thereafter pushed back in, logic circuit 103 once again sends correction pulses to driving circuit 104 and to counters 105 and 109. These pulses are such as to cause motor M to run in the direction which returns the hands to a position indicating the correct time, and to cause difference counter 109 to be reset. Once more, when counter 109 reaches zero, logic circuit 103 cuts off the supply of correction pulses and resumes transmission of the time-standard pulses to driving circuit 104 and to display counter 105.

Finally, if contact 15 is closed while contact STOP is open, logic circuit 103 again sends correction pulses to driving circuit 104 and to counters 105 and 109, but this time in such a way that the hands are driven over the shortest route to a position corresponding to the alarm time stored in memory 106. This means that, in this case, these correction pulses are supplied by logic circuit 103 dependent upon and ouptut signal from comparator 107, indicating whether the stored alarm time is before or after the correct time displayed by the hands upon closing of contact 15. When comparator 107 indicates that the count of display counter 105 equals the information stored in alarm-time memory 106, logic circuit 103 cuts off the supply of correction pulses. After a certain lapse of time, circuit 103 resumes transmission of correction pulses, so that the hands now move toward the position in which they indicate the correct time. As in the preceding cases, when difference counter 109 reaches zero, logic circuit 103 stops sending correction pulses and resumes transmission of time-standard pulses to driving circuit 104 and display counter 105.

It should be noted that, in any case, logic circuit 103 sends time-standard pulses to difference counter 109 as long as the watch is not in its normal operating state. Hence these pulses are not lost, and the watch always indicates the correct time at the end of the various special operations described above.

Moreover, the existence of difference counter 109 makes it possible to carry out the functions of setting the watch or changing the time zone in a particularly simple manner.

When contact STOP is closed by pulling out stem 17, and when contact 20 or 21 is closed by rotation of stem 17, motor M receives correction pulses from logic circuit 103 as described above. If stem 17 is thereafter pushed back into its rest position without contact 15 being closed, there are two possible situations which may exist:

if the count of difference counter 109 indicates that the hands have been moved by less than 15 minutes, for instance, in one direction or the other, logic circuit 103 assumes that the purpose of that movement was to set the watch. Circuit 103 then resets the whole difference counter 109 in response to the opening of contact STOP, and the watch starts running again from the position occupied by the hands at that moment.

if, on the other hand, the count of difference counter 109 indicates that the hands have been moved by more than 15 minutes in one direction or the other, logic circuit 103 assumes that the purpose of that movement was to change the time zone and therefore resets only that part of difference counter 109 which counts the number of full hours of divergence between the position indicated by the hands and the correct time. Circuit 103 again sends correction pulses to driving circuit 104, to display counter 105, and to difference counter 109, in a direction determined by the count of counter 109. As the full-hour counter of the latter has been reset, only the count of the minute counter affects the resulting movement of the hands. If this count is more than zero but less than 30, logic circuit 103 causes the hands to move backward until the count of counter 109 is zero. If, on the contrary, the count of the minute counter of counter 109 is equal to or greater than 30 but equal to or less than 59, logic circuit 103 causes the hands to advance until the count of counter 109 is zero. At the end of these operations, the watch indicates the correct time in a different time zone from the original one.

Figure 7:
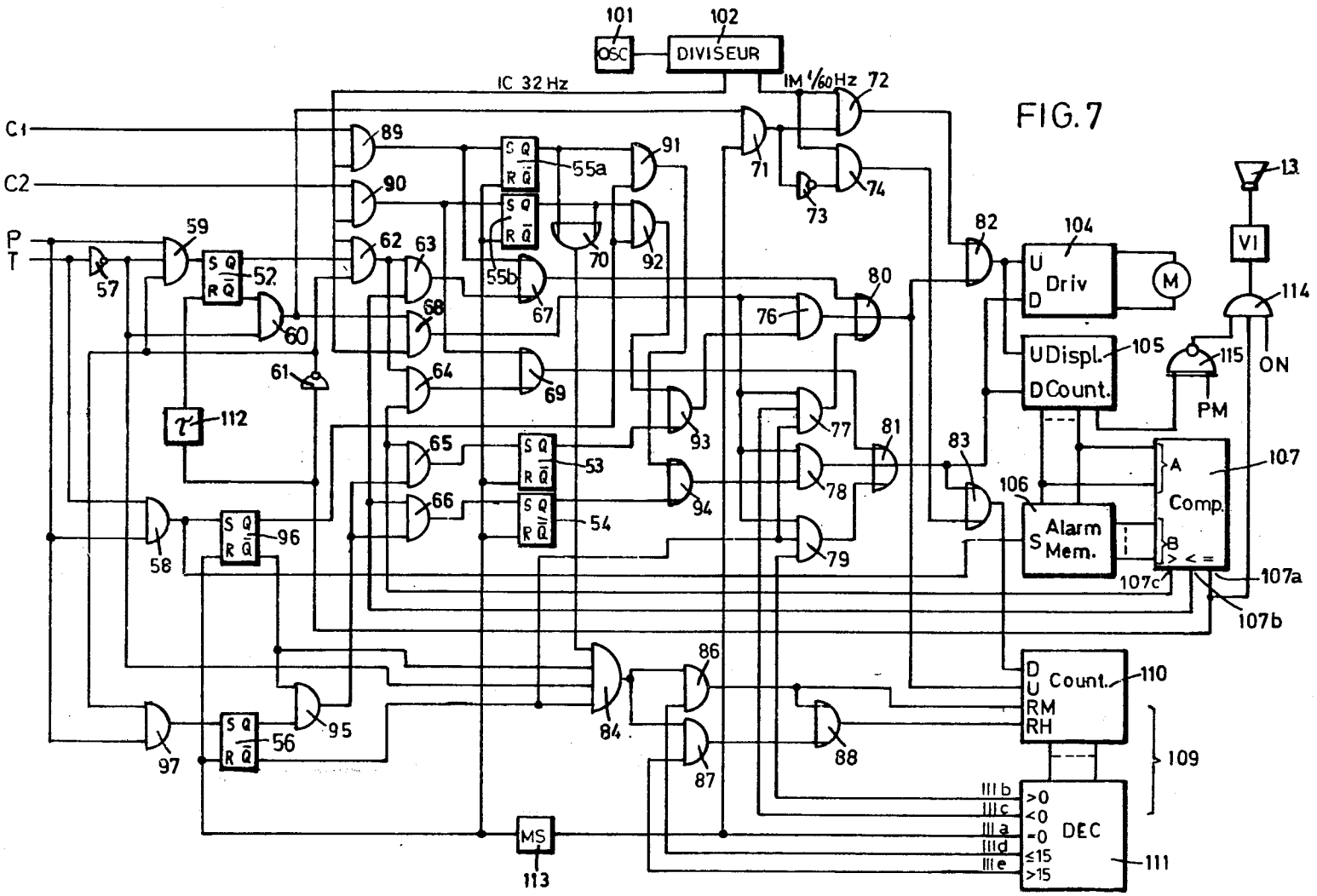
FIG. 7 is a block diagram of the embodiment according to FIG. 3.

FIG. 7 is a detailed diagrammatic example of the circuit in the embodiment of FIG. 3, a description of the mode of operation being given below.

GENERAL ASPECTS

Reappearing in FIG. 7 are oscillator 101, frequency divider 102, motor M which receives driving pulses from driving circuit 104, display counter 105, alarm-time memory 106, comparator 107, and difference counter 109 composed of a counter proper, 110, and a decoder 111.

Figure 8:
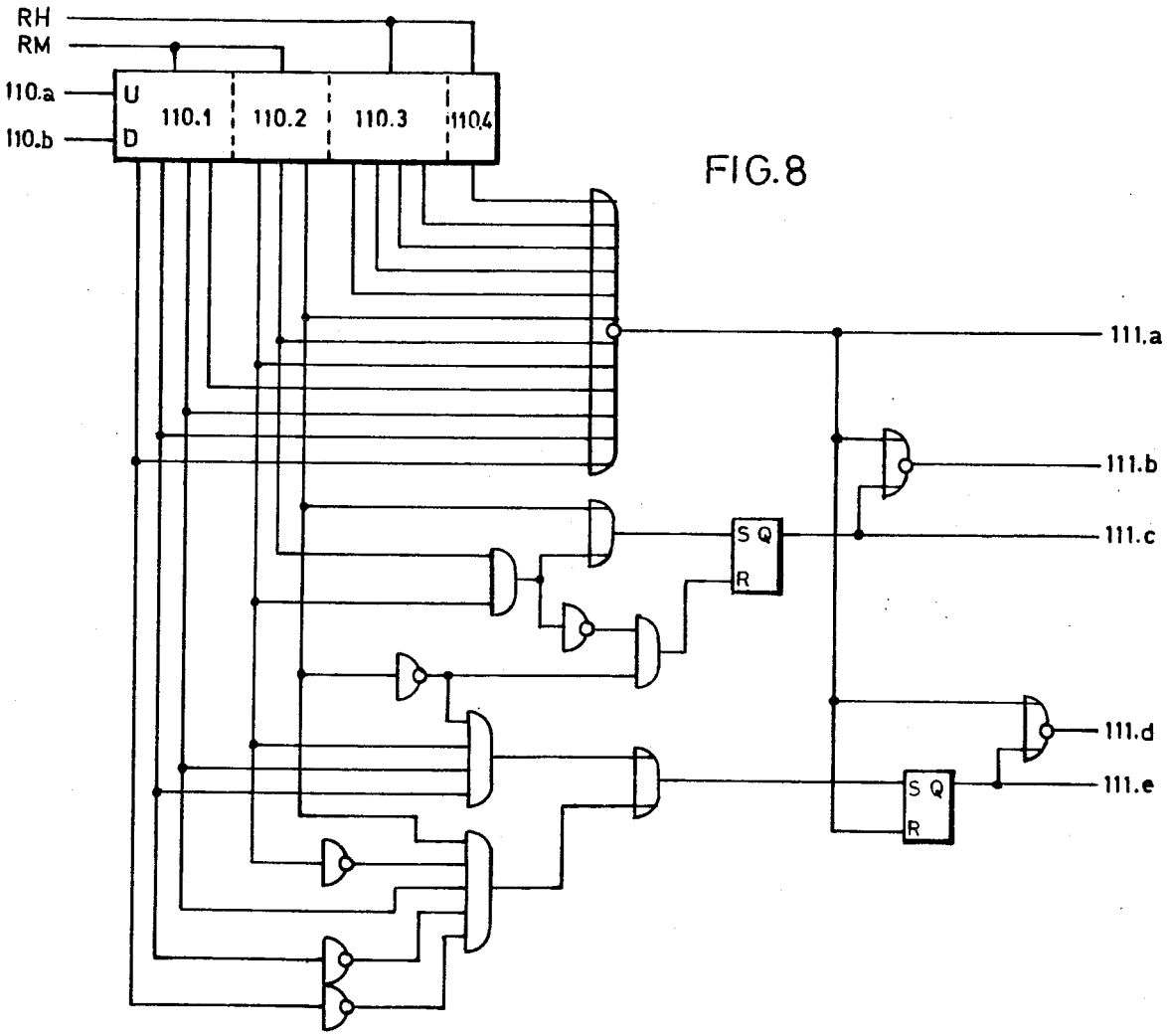
FIG. 8 is a detailed block diagram of a portion of the electronic unit shown in FIG. 7.

As may be seen in FIG. 8, counter 110 comprises a minute counter which is in turn composed of a units-of-minutes counter 110.1 and a tens-of-minutes counter 110.2. The outputs of the four flip-flops conventionally forming counter 110.1 provide the count thereof, in binary form, which may vary from 0 to 9 or from 9 to 0 according to which input, **110.*a* or 110.*b*, receives the counting pulses. The outputs of the three flip-flops forming counter 110.2** likewise provide in binary form the count thereof, which may vary from 0 to 5 or from 5 to 0.

Counter 110 further comprises an hour counter 110.3 composed of a first series of four flip-flops connected so as to be able to count from 0 to 11 or from 11 to 0, and of an additional flip-flop 110.4 which, according to its state, makes it possible to differentiate between A.M. and P.M.

Minute counters 110.1 and 110.2 and hour counters 110.3 and 110.4 can be reset individually by signals applied to the inputs designated RM and RH, respectively. The remainder of FIG. 8 relates to decoder 111 which need not be described in detail. An analysis of the diagram readily shows that output **111.*a* is at binary "1" when the count of counter 110 as a whole is zero, that output 111.*b* is at "1" when the count of the minute counter is more than zero but less than 30, and that output 111.*c* is at "1" when the count of the minute counter is equal to or more than 30 but equal to or less than 59. Output 111.*d* is at "1" as long as the minute counter has not counted more than 15 pulses up or down. Finally, output 111.*e* changes to "1" as soon as the minute counter has counted 16 or more pulses up or down, and it remains at "1" as long as counter 110** has not been wholly reset.

Driving circuit 104 as depicted in FIG. 7 has two inputs designated U and D. Each pulses arriving at either of these inputs gives rise to a driving pulse causing motor M to move the hands through an angle corresponding to one minute, the hands moving ahead if the pulse arrives at input U and back if it arrives at input D.

Display counter 105 is made up in exactly the same way as difference counter 110 described above. Each pulse it receives at its inputs U or D respectively increases or decreases its count by one unit.

NORMAL OPERATION

Inputs P, T, C1, and C2 of the circuit diagrammed in FIG. 7 are connected to contacts 15, STOP, 20, and 21, respectively, of the diagram of FIG. 3 via anti-bouncing circuits (not shown). These circuits are such that inputs P, T, 01, and 02 are at binary "0" when contacts 15, STOP, 20, and 21 are open and at binary "1" when these contacts are closed. During normal operation of the watch, therefore, inputs P, T, C1, and C2 are at "0".

Flip-flops 52, 53, 54, **55*a*, 55*b*, 56, and 96 shown in FIG. 7 are all of the R-S type. During normal operation of the watch, their Q outputs are at "0" and their $\overline{Q}$ outputs at "1". Finally, counter 110 is at zero. Output 111*a* of decoder 111** is therefore at "1", the other outputs of this decoder at "0".

An AND gate 72 receives at one of its inputs the time-standard pulses supplied by divider 102 at a frequency of 1/60 c/s and designated IM. The other input of gate 72 receives a potential corresponding to binary "1" via two AND gates 60 and 71 whose inputs are easily seen to be at "1". The time-standard pulses are thus transmitted by the output of gate 72 to the inputs U of driving circuit 104 and counter 105 via an OR gate 82. Hence the hands advance by one minute, and the count of counter 105 increases by one unit, with each pulse IM.

The binary level of the flip-flops making up display counter 105, except for the A.M./P.M.-differentiating flip-flop, is applied to inputs A of comparator 107, which compares this level with that of the eleven flip-flops making up alarm-time memory 106, applied to inputs B of comparator 107.

When the binary level of inputs A becomes indentical with that of inputs B, i.e., when the time displayed by the hands is identical with the stored alarm time, output 107*a* of comparator 107 supplies a "1" signal to an input of an AND gate 114. By means not shown, gate 114 receives a "1" signal at a second input, designated as ON in FIG. 7, when movable part 16 (FIG. 1) is not in the NO-indicating position, i.e., when the alarm device is on. Finally, gate 114 also receives a "1" signal at a third input, connected to the output of an EXCLUSIVE NOR gate 115, when the level of the A.M./P.M.-differentiating flip-flop is identical with that of a signal likewise coming from movable part 16 and corresponding to binary "1" when part 16 displays the indication PM.

When the three inputs of gate 114 are at "1", the alarm device, formed by circuit VI and transducer 13, sounds the alarm.

STOPPING THE WATCH

When contact STOP is closed, input T changes to "1". Gate 72 is then disabled by a "0" level received via gates 60 and 71 from an inverter 57 the input of which is connected to input T. Driving circuit 104 therefore ceases supplying driving pulses to motor M, which stops, and display counter 105 remains in its last state.

An AND gate 74, one input of which is connected via an inverter 73 to the output of gate 71, and the other input of which also receives pulses IM, then transmits the latter to input D of counter 110 via an OR gate 83.

The count of counter 110 starts to decrease, going from 0 to 23 hours 59 minutes, then to 23 hours 58 minutes, etc., with each pulse IM it receives. Output 111*a* of decoder 111 thus changes to "0", and output 111*c* thus changes to "1".

If the stem is pushed back in without contacts 15, 20, and 21 having been closed, the output of gate 60 returns to "1", but the output of gate 71 remains "0" because of the potential corresponding to "0" which it receives from output 111*a* of decoder 111. An AND gate 68, having one input connected to the output of gate 60 and another input which receives pulses IC from divider 102 at a frequency of 32 c/s, for example, conducts these pulses toward an AND gate 77 having one input connected to the output of gate 68, another input connected to the $\overline{Q}$ output of flip-flop 56, and a third input connected to output 111*c*. Since this last output is at "1", pulses IC pass through gate 77 and reach the inputs U of driving circuit 104 and display counter 105, through an OR gate 80 and gate 82, as well as input U of counter 110. Motor M therefore advances the hands until counter 110 reaches zero. At that moment, output 111*c* returns to "0", and output 111*a* returns to "1". The output of gate 71 therefore returns to "1" and the outputs of gates 74 and 77 to "0". The watch is once more in its normal operating state.

DISPLAY OF THE STORED ALARM TIME

If, in this normal operating state, contact 15 is closed by actuation of push button 14, input P changes to "1" and a level "1" appears at the outputs of two AND gates 59 and 97. Flip-flops 52 and 56 therefore flip, and their Q outputs change to "1".

One of the outputs 107*a*, 107*b*, or 107*c* of comparator 107 is at binary "1" when the count of display counter 105 is respectively equal to, less than, or greater than the contents of alarm-time memory 106. An AND gate 62, having a first input connected to the Q output of flip-flop 52, a second input connected to output 107*a* of comparator 107 via an inverter 61 so that it is at "1" if output 107*a* is not at "1", and a third input receiving pulses IC from divider 102, therefore starts transmitting these pulses IC to its output. If output 107*b* of comparator 107 is at "1", pulses IC are transmitted to inputs U of driving circuit 104 and of counters 105 and 110 through an AND gate 63, an OR gate 67, and gates 80 and 82. If it is output 107*c* of comparator 107 which is at "1", pulses IC are transmitted to inputs D of driving circuit 104 and of counters 105 and 110, through an AND gate 64, OR gates 69 and 81, and gate 83. In the first case, where the correct time represents a smaller number than the stored alarm time, motor M causes the hands to advance. In the second case, it causes them to move backward. In both cases, this movement ceases as soon as output 107*a* of comparator 107 changes to "1", which indicates that the stored alarm time is now displayed by the hands. At the same time that flip-flop 56 flipped, upon closing of contact 15, the output of an AND gate 65 or of an AND gate 66 changed to "1". Each of these gates has an input connected to the Q output of flip-flop 56 through an AND gate 95, while their other inputs are connected to outputs 107*c* and 107*b*, respectively, of comparator 107. Thus, either flip-flop 53 or 54 flipped upon closing of contact 15, depending upon whether output 107*b* or output 107*c* was at "1". A certain length of time after output 107*a* has changed to "1", flip-flop 52 is reset by a signal it receives from a delay circuit 112, the input of which is connected to output 107*a*.

The output of gate 60 thus returns to "1", and gate 68 resumes transmission of pulses IC. According to whether it was flip-flop 53 or 54 which flipped, these pulses are transmitted through an AND gate 76, having an input connected to the Q output of flip-flop 53 via an OR gate 93, or through an AND gate 78, having an input connected to the Q output of flip-flop 54 via an OR gate 94. Depending upon the case, therefore, pulses IC are transmitted to inputs U or to inputs D of driving circuit 104 and of counters 105 and 110.

It will readily be seen that motor M is driven in the opposite direction from that in which it ran to bring the hands into the position where they display the stored alarm time, and that counters 105 and 110 count in the corresponding direction.

When counter 110 arrives at zero, output 111*a* of decoder 111 returns to "1". Flip-flops 53 or 54 and 56 are reset by a short pulse supplied by a monostable circuit 113, the input of which is connected to output 111*a*. Transmission of pulses IC via gates 76 or 78 is therefore cut off. Gate 72 resumes transmission of pulses IM and the watch is again in its normal operating state.

STORING A NEW ALARM TIME

When one of the contacts 20 or 21 is closed by rotation of crown 2 while contact STOP is closed, i.e., when the stem is pulled out, the corresponding input C1 or C2 changes to "1". Pulses IC are then transmitted via an AND gate 89 or via an AND gate 90 to the S input of flip-flop 55*a* or of flip-flop 55*b*, on the one hand, and to inputs U of driving circuit 104 and of counters 105 and 110, through gates 67, 80, and 82, or to inputs D of circuits 104, 105, and 108, through gates 69, 81, and 83, on the other hand. Motor M is thus driven in one direction or the other, and counters 105 and 110 count in the corresponding direction, until contact C1 or C2, which had been closed, is again opened.

If, at this moment, contact 15 is closed by pressure on push button 14, input P changes to "1". The output of an AND gate 58, the inputs of which are connected to inputs P and T, therefore changes to "1". Flip-flop 96 flips, and its Q output likewise changes to "1". Alarm-time memory 106 also receives this "1" signal at its input S.

Alarm-time memory 106 is made up conventionally of flip-flops of the D type, for example. The D input of each of these flip-flops is connected to one of the outputs of display counter 105, and the clock inputs of all these flip-flops are connected to input S. The "1" signal transmitted by the output of gate 58 when push button 14 is pressed therefore causes alarm memory 106 to store the count of display counter 105, which corresponds to the time indicated by the hands at that moment.

When the stem is thereafter pushed back in, input T returns to "0". The output of gate 60 therefore returns to "1", and the output of gate 68 resumes transmission of pulses IC.

If it is the Q output of flip-flop 55*a* which is at "1", i.e., if motor M has been driven forward in response to the closing of contact 20, the output of an AND gate 91, the inputs of which are connected to the Q outputs of flip-flop 55*a* and flip-flop 96, is at binary "1". Hence the output of gate 94 is likewise at "1", and pulses IC are transmitted via gates 78, 81, and 83 to inputs D of driving circuit 104 and of counters 105 and 110. Motor M is therefore driven in reverse until counter 110 reaches zero. The pulses which appears at that moment at the output of monostable circuit 113 resets all the flip-flops which had flipped, and the watch is once more in its normal mode of operation.

If it is the Q output of flip-flop 55*b* which is at "1", the operation of the circuit is similar to what has just been described. An AND gate 92, the inputs of which are connected to the Q outputs of flip-flops 55*b* and 96, applies a "1" signal to the input of AND gate 76, through gate 93. Thus, pulses IC supplied by the output of gate 68 when the stem is pushed in can pass through gate 76 and, through gates 80 and 82, reach inputs U of driving circuit 104 and of counters 105 and 110. Motor M is therefore driven forward until counter 110 reaches zero.

SETTING THE WATCH AND CHANGING THE TIME ZONE

As has been seen above, the existence of difference counter 109 makes it possible to carry out the functions of setting the watch and changing the time zone as well.

If the stem is pulled out and turned in one direction or the other, motor M moves the hands ahead or back, as explained above. When the stem is pushed in again after this operation, without push button 14 having been actuated two possible situations may exist:

if the movement of the hands was such that difference counter 110 counted less than sixteen pulses, in one direction or the other, output 111*d* of decoder 111 is at binary "1". The "1" signal which appears at the output of inverter 57 when the stem is pushed in is applied to the two inputs RM and RH of counter 110, via two AND gates 84 and 86 and an OR gate 88. The entire counter 110 is therefore reset, which causes the immediate appearance of a "1" level at output 111*a* of decoder 111. The flip-flops which had flipped are reset, and the watch resumes normal operation. The function of setting the watch has thus been carried out.

If, on the other hand, the movement of the hands was such that counter 110 counted sixteen or more pulses, output 111*d* of decoder 111 is at "0" and output 111*e* at "1". Gate 86 is thus disabled by the "0" level it receives from output 111*d* of decoder 111. The "1" signal which appears at the output of gate 84 when the stem is pushed in is applied this time only to input RH of counter 110, via an AND gate 87. Only the hour counter of difference counter 110 is then reset. Pulses IC, which are, as always, transmitted by gate 68 when the stem is pushed in, reach inputs U or D of driving circuit 104 and of counters 105 and 110 through AND gates 77 or 79 depending upon whether output 111*b* or output 111*c* of decoder 111 is at 37 1" after this resetting of the hour counter. Once again, the transmission of pulses IC is interrupted, and the watch resumes normal operation as soon as counter 110 reaches zero.

It should be noted that counter 110 cannot be partially or totally reset unless one of the contacts 20 or 21 has first been closed. If this is not done, the output of an OR gate 70, the inputs of which are connected to the Q outputs of flip-flops 55*a* and 55*b*, is at "0", thus disabling gate 84 and preventing any resetting of counter 110.

It will be seen that these arrangement make it possible to change the time zone with ease, for it suffices to move the hands to approximately the new time by rotating the pulled-out stem. When the stem is pushed in again, the circuit automatically puts the hands at exactly the time it is in the new time zone.

FIGS. 4, 5, and 6 are top plan views of electronic alarm wrist watches constituting embodiments of the invention and having different sorts of display devices In each of these drawing figures, a watch case 25, shown schematically, bears a glass 26 and is equipped with crown 2 and push button 14. Disposed beneath glass 26 is dial 27 which includes a chapter-ring 28, an aperture 29 through which the date is visible, and an aperture 30 through which one of the indications AM, PM, or NO, borne by rotary part 16, is visible.

In the case of FIG. 4, the display system includes two hands, viz., hour hand 6 and minute hand 7. In the embodiment of FIG. 5, there is added to hands 6 and 7 a seconds hand 31 disposed at the location corresponding to 6 o'clock and moving over a zone 32 of dial 27 to count the seconds of each minute.

Finally, in FIG. 6, a seconds hand 33 coaxial with hands 6 and 7 is provided in addition to the latter. In the two embodiments illustrated in FIGS. 5 and 6, where a seconds hand is provided, this hand 31 or 33 will be keyed on the arbor of a fourth wheel which may be either permanently kinematically connected to the gear-train or, in other embodiments, driven by other means.

What is claimed is:

1. Electronic time-piece comprising:
means for displaying time data;
means for producing a time base signal;
means for producing a first and a second manual command;
means for producing a control signal;
means responsive to said time base signal and to said control signal for driving said displaying means;

means responsive to said time base signal and to said control signal for producing a displaying means position signal;

means responsive to said first manual command and to said position signal for storing an alarm time signal;

means responsive to said position signal and to said alarm time signal for producing a comparison signal;

means responsive to said comparison signal for producing an alarm signal; and means responsive to said manual commands, to said control signal and to said time base signal for producing a difference signal:

wherein said control signal producing means is responsive to said comparison signal, to said difference signal and to said manual commands for producing said control signal.

2. The electronic time-piece of claim 1 wherein said means for producing a control signal is constructed to control the application of said time base signal to one of said means for driving said displaying means and said means for producing a difference signal, in response to said means for producing a first and second manual command.

3. The electronic time-piece of claim 1 wherein said means for producing a control signal is constructed to provide rapid pulses to said means for driving said displaying means and said means for producing a difference signal in response to said means for producing a first and second manual command.

4. The electronic time-piece of claim 1 wherein said means for producing a control signal causes a transfer of a displaying means position signal to said means for storing an alarm time signal in response to said means for producing a first and second manual command.

5. The electronic time-piece of claim 1 wherein said means for producing a control signal is constructed to direct rapid pulses to said means for driving said displaying means and to said means for producing a difference signal in response to said means for producing a first and second manual command until said means for producing a difference signal is zero.

6. The electronic time-piece of claim 1 wherein said means for producing a control signal is constructed to direct rapid pulses to said means for driving said displaying means and to said means for producing a difference signal in response to said means for producing a first and second manual command and further wherein said means for driving said displaying means and said means for producing a displaying means position signal receive rapid pulses until said means for producing a comparison signal is zero so that said means for displaying time data displays a memorized alarm time and thereafter delivers rapid pulses to return said means for producing a displaying means position signal to a state corresponding to actual time.

* * * * *